United States Patent [19]

Stover

[11] 4,025,316

[45] May 24, 1977

[54] MANNICH BASE REACTION PRODUCTS USEFUL AS LIQUID HYDROCARBON ADDITIVES

[75] Inventor: William Harold Stover, Sombra, Canada

[73] Assignee: Exxon Research and Engineering Company, Linden, N.J.

[22] Filed: Nov. 6, 1974

[21] Appl. No.: 521,282

[52] U.S. Cl. ..... 44/58; 44/73; 252/51.5 R

[51] Int. Cl.[2] ..... C10L 1/22

[58] Field of Search ..... 44/58, 73; 252/47.5, 252/51.5 R

[56] References Cited

UNITED STATES PATENTS

| | | | |
|---|---|---|---|
| 2,962,442 | 11/1960 | Andress, Jr. | 44/73 |
| 3,269,810 | 8/1966 | Chamot | 44/73 |
| 3,368,972 | 2/1968 | Otto | 44/73 |
| 3,649,229 | 3/1972 | Otto | 44/73 |

*Primary Examiner*—Daniel E. Wyman
*Assistant Examiner*—Mrs. Y. Harris-Smith
*Attorney, Agent, or Firm*—Roland A. Dexter; Frank T. Johmann

[57] ABSTRACT

Polymeric alkyl-hydroxy benzyl N-substituted amines having a high degree of ring formation are derived from the condensation reaction of $C_8$–$C_{40}$ aliphatic alkyl substituted hydroxy aromatic, an aldehyde and an amine, wherein the molar ratio of said aromatic to said amine is about 2 to one, with said aldehyde being present in a molar amount in excess of said aromatic. These novel amines are useful as a detergent and/or antioxidant additive for liquid hydrocarbons, e.g., in lubricating oils for gasoline engines that have a two stroke cycle.

8 Claims, No Drawings

MANNICH BASE REACTION PRODUCTS USEFUL AS LIQUID HYDROCARBON ADDITIVES

BACKGROUND OF THE INVENTION

The present invention concerns improved lubricating oils such as those useful for gasoline engines of the type that are lubricated by mixing the oil with the fuel that is fed to the engine. Ordinarily this lubricating procedure is employed for gasoline engines having a 2-stroke cycle, for example, outboard motors for powering various types of boats. In particular it is concerned with lubricating oils for such 2-stroke gasoline engines containing Mannich base additives made from alkyl phenols, aldehydes and amines.

Usually when lubricating a 2-stroke-cycle gasoline engine, the lubricating oil is mixed with the fuel to the engine in a ratio of 1 volume of lubricant to form about 20 to 80 volumes of fuel. The mixture first enters the crankcase where the mixture of lubricant and unvaporized fuel contacts and lubricates the various moving surfaces including the bearings, pistons, piston rings and cylinders. All of the lubricant that does not deposit on the surfaces in the lower part of the engine passes into the combustion chamber where it is burned along with the fuel. The amount of lubricant that thus reaches the combustion chamber is much greater than the amount of lubricant that is normally burned in an automotive-type gasoline engine, i.e., a 4-stroke engine employing a crankcase and crankcase oil. Because of this, combustion-chamber-deposit-induced problems (e.g., ring sticking and preignition) are prevalent. These result in power loss, runaway preignition and sometimes piston failure can occur. Power loss due to spark plug fouling from combustion chamber deposits is usually the first performance limitation encountered.

High temperatures resulting from preignition or other causes (e.g., cooling failures, improperly lean mixtures, ignition system malfunctioning), can lead to insufficient lubrication near the exhaust ports, excessive wear, scuffing, scoring, and even seizure.

There has been an increased need for a lubricating oil composition that will be more suitable than conventional motor oils for 2-stroke-cycle engines, particularly for outboard motor service. Certain makes of engines are more critical than others. In general, modern high horsepower (i.e., above 25 horsepower, and particularly above 40 horsepower) outboard motors produce more piston, ring zone and cylinder deposits than do lower horsepower models. Severe plug fouling and preignition conditions are presented by full throttle operation with highly leaded fuel (2 to 3 ml. per gallon) and ash containing lubricants.

A high performance, 2-stroke-cycle engine lubricant should be readily miscible with gasolines and should (1) provide good lubrication (low friction, low wear, and no deformation, scuffing, scoring or seizing) of the rubbing parts such as antifriction bearings, piston rings and cylinders; (2) maintain a clean combustion chamber with attendant long spark plug life and freedom from preignition; and (3) control deposits.

Compounding a lubricant to maximize all of these benefits in all applications of 2-stroke engines (of the type fueled and lubricated by a mixture of gasoline and oil) is not a simple matter of adding conventional crankcase lubricating oil ingredients with known functions, because of interaction effects. That is, conventional lube oil additives, employed for their known beneficial properties, can have detrimental effects. Thus, some detergents can keep the piston clean, but at the expense of poor lubrications, lower spark plug life and more preignition. These interaction effects require a very specially compounded lubricant to minimize operating troubles and to maximize performance and life.

A commercially available ashless two cycle oil additive package comprises an amide-imide prepared by reacting isostearic acid with a polyethylene amine believed to be essentially tetraethylene pentamine in a mol ratio of 3 moles of acid to one mole of amine (see U.S. Pat. No. 3,100,673) with mineral oil as the diluent. Additive package treats for 2-stroke-cycle gasoline engines, particularly the high performance water cooled engines used in boating, ranges from 8.25–9.75 volume percent of additive.

Mannich bases as engine oil additives are well known and have been widely reported in the patent literature, e.g, U.S. Pat. Nos. 2,348,638; 2,353,491; 2,459,112; 2,459,113; 2,459,114; 2,459,115; 2,459,116; 2,723,907, and 3,036,003.

These additives which are particularly effective for engine oils are based upon condensation products of hydroxyaromatic, an aldehyde and an amine. These additives are often multifunctional in character, acting as antioxidants, dispersants and as pour depressants therein. These compounds have also been recognized as exhibiting detergent properties. Hydroxyaromatic compounds which are substituted by a short chain alkyl group or by a relatively high molecular weight straight chain aliphatic hydrocarbon derived from chlorinated wax such as wax phenols, referred to in U.S. Pat. No. 2,459,114, are also suitable.

A class of alkyl hydroxybenzyl substituted polyamines closely related to those of the present invention is that resulting from the reaction of from 0.5 to 2 moles each of $C_4$ to $C_{20}$ alkyl phenol and formaldehyde for each basic nitrogen in an alkylene polyamine. The alkylene polyamines usually used are the di-, tri- and tetra-ethylene, tri-, tetra and pentamines. The resulting products, illustrated in U.S. Pat. No. 3,036,003, include some disclosed to be useful per se in lubricant oil formations as ashless-type detergents.

U.S. Pat. No. 3,539,633 teaches that dispersant-detergent-antioxidant hydroxy-alkylbenzyl substituted alkylene polyamines are obtained from $C_{50}$ and higher carbon content alkylphenols reacted with formaldehyde and alkylene polyamines with the molar ratios are 1.0—1.5:1.5—2.0:1.0—1.5, respectively. The aforementioned hydroxy ($C_{50}$ and higher) alkylbenzyl substituted alkylene polyamines are also useful as lubricant additive compounds when reacted with a boron compound which forms a coordinate boron complex with polar groups present.

In none of the foregoing patents is there any teaching that other than about an equimolar amounts of the hydroxy aromatic (phenolic) compound and the aldehyde should be employed in the Mannich reaction when the molar ratio of the aromatic to amine is about 2 to 1. None of these publications relating to Mannich bases suggest that the bases would be useful as a detergent-antiscuff additive for lubricants useful in 2-stroke cycle gasoline engines; particularly large water cooled engines, e.g., the 130 horsepower outboard.

SUMMARY OF THE INVENTION

In accordance with this invention, an improved lubricating oil composition exhibiting maximum performance in 2-stroke-cycle engine service is formulated by combining:

1. a clean-burning, highly refined petroleum lubricating oil base stock having a viscosity from 58 to 85 S.U.S. at 210° F with 2. from 3 to 20 volume percent of certain liquid hydrocarbon soluble detergents-anti-scuff additives to be defined later in this specification.

Highly useful additives of the invention are the products of the Mannich reaction of an essentially linear octadecyl phenol with a polyamine and paraformaldehyde having a molar ratio of 2:1:2–8; respectively. Preferred is a molar ratio of about 2:1: 3–7, respectively. Optimally is a molar ratio of about 2:1:4 where the amine is ethylene diamine; about 2:1:5 where the amine is diethylene triamine; and about 2:1:6 where the amine is tetraethylene pentamine.

DESCRIPTION OF THE PREFERRED EMBODIMENTS OF THE INVENTION

As stated above, the base stocks for the lubricating oil composition of this invention should be clean-burning. Base stocks having viscosities at 210° F in the range of 58 to 85 S.U.S. are used. Preferably the base stock should be a naphthenic (e.g., Coastal) distillate that has been extracted to a viscosity index of from 60 to 80 and should have the viscosity at 210° F of from 63 to 75 S.U.S. These stocks have particularly low Conradson Carbon residues, of less than 0.1 weight percent. While these are the preferred stocks, higher V.I. oils of 90–115 may be used. Highly refined residual stocks (i.e., bright stocks) burn less completely than highly refined all-distillate stocks, but these refined residuals are useful in limited amounts — i.e., to the extent of 5 to 25 volume percent of the total formulated oil in some 2-stroke-cycle engine applications.

The detergent antiscuff additives of this invention should comprise from 3 to 20 volume percent of the additive package. The detergent-antiscuff additives used in the composition of the present invention are defined as condensation bases having a high degree of ring formation derived from the Mannich reaction of an alkyl substituted hydroxy aromatic compound, an aldehyde and an amine. As noted above, Mannich bases and their preparation are generally well known in the art.

ALKYL SUBSTITUTED HYDROXY AROMATIC COMPOUNDS

Representative hydroxyaromatic compounds contemplated by the present invention are phenol, resorcinol, hydroquinone, catechol, cresol, xylenol, hydroxydiphenyl, benzylphenol, phenylethylphenol, phenol resins, methylhydroxydiphenyl, guiacol, alpha and beta naphthol, alpha and beta methylnaphthol, tolylnaphthol, xylylnaphthol, benzylnaphthol, anthranol, phenylmethylnaphthol, phenanthrol, monomethyl ether of catechol, methoxyphenol, phenoxyphenol, chlorophenol, and the like. Preference in general is to the monohydroxy phenols otherwise unsubstituted, particular preference being given to phenol and alpha and beta naphthol.

The hydroxyaromatic compounds may also contain one or more substituent groups such as carboxyl, halogen, nitro and the like.

The alkyl substituent contains from about 8 to about 40 carbon atoms. Although linearity of the carbon chain is preferred, branching is acceptable although the anti-scuff performance is lessened.

These useful alkyl substituted hydroxy aromatic compounds are derived from essentially linear $\alpha$-olefins of 8 to 40 carbon atoms, preferably 14 to 24 carbon atoms and optimally 16 to 20 carbon atoms, reacted with phenol.

The alkyl substituted phenols of this invention may be made by reacting –20 moles of a phenol with one mole of an alpha olefin in the presence of an alkylating catalyst such as $BF_3$ (including the etherate, phenolate or phosphate complexes), acidic activated clays or strong acid ion exchange resins. This process is particularly effective when conducted by reacting 3 to 7, or especially 5 moles, of phenol to 1 mole of the $\alpha$-olefin in the presence of an acid exchange resin or activated clay. The product is conveniently separated from the catalyst by filtration or decantation. Unreacted phenol is removed by distillation, leaving as a residue the product which is over 90% mono-substituted alkyl phenol.

The preparation of the high molecular weight alkyl-substituted phenols used in this invention may be illustrated by the preparation of iso-octadecyl phenol which appears to contain more ortho than para substitution, whereas products made from branched olefins are mainly para substituted. This difference in turn affects the composition of Mannich bases prepared from these two types of alkylphenols, which differences will be discussed in a later section.

The amount of di and trialkyl substitution with linear alpha olefins depends on the phenol:olefin mole ratio used and on the catalyst:

TABLE I

| | Run | | | |
|---|---|---|---|---|
| Alkylphenol | A | B | C | D |
| Olefin | | Octadecene-1 | | |
| Phenol:Olefin (mole) | 1:1 | 5:1 | 10:1 | 5:1 |
| Catalyst | $BF_3$/phenol | $BF_3$/phenol | $BF_3/H_2O$ | Acidic Clay |
| Substitution, % | | | | |
| Mono | 53* | 81** | 85** | 96* |
| Di | 41 | 18 | 15 | 4 |
| Tri | 6 | | | — |

*By GC analysis, area %
**By distillation, wt. %

As the above tabulation shows, at a 5:1 mole ratio of phenol to octadecene-1, the conversion to monoalkylphenol is significantly higher with the clay catalyst, i.e., 96% vs 85% for $BF_3$. Clay is thus the preferred catalyst in terms of selectively to monoalkylphenol. Acid exchange resins give about the same selectivity to monoalkylphenol at a given mole ratio.

Typical yields for alkylphenols from alpha olefins are summarized in the following tabulation.

TABLE II

| | Run | | | |
|---|---|---|---|---|
| | E | F | G | H |
| Olefin | 1-Octadecene | 1-octadecene | 1-octadecene | $C_{20-24}$- |

TABLE II-continued

| | | | | |
|---|---|---|---|---|
| Phenol:Olefin (mole) | 10:1 | 5:1 | 5:1 | 10:1 |
| Catalyst | $BF_3 . H O$ | $BF_3$ . phenol | Acidic Clay | $BF_3$ . phenol |
| Yield, wt % on Olefin | | | | |
| Monoalkyl phenol | 107 | 103 | — | — |
| Total alkyl-phenol | 125 | 128 | 135 est. | 124 |

*The carbon number distribution of this commercially available material was:

| | Wt. % |
|---|---|
| $C_{18}$ | 1 |
| $C_{20}$ | 49 |
| $C_{22}$ | 42 |
| $C_{24}$ | 8 |

Typical yields for the branched olefins are summarized below:

TABLE III

| Run | I | J | K |
|---|---|---|---|
| Olefin | $C_{24}$[1] | Lubrafin 10[2] | Lubrafin 10[2] |
| Phenol:Olefin (mole) | 10:1 | 10:1 | 10:1 |
| Catalyst | $BF_3$ . phenol | $BF_3$ . phenol | $BF_3$ . ether |
| Yield, wt % on Olefin | | | |
| Total alkylphenol | 120 | 133 | 117 |

[1]A mixture of polypropylenes having a carbon number distribution of about 2 vol. % $C_{15}$; 9 vol. % $C_{18}$; 22 vol. % $C_{21}$; 31 vol. % $C_{24}$; 24 vol. % $C_{27}$; 10 vol. % $C_{30}$; and 3 vol. % $C_{33}$.
[2]Commercially available from Petrofina Canada and having an average molecular weight of about 440.

Although Run I gave high total alkylate yield, the product contained a substantial amount of alkyl side chains with only 4 to 8 carbons; whereas in Run K, fragmentation was less a problem.

The products from $C_{10}$ to $C_{18}$ alpha olefins are low viscosity liquids at ambient temperature, while that obtained from the $C_{20-24}$ fraction was partially crystalline. The products of Runs I-J were very viscous alkylphenols.

ALDEHYDES

Aldehydes contemplated by the present invention are the aliphatic aldehydes, such as formaldehyde polymers and acetals or paraformaldehyde, typified by formaldehyde (such as trioxymethylene), acetaldehyde, and aldol ($\beta$-hydroxy butyraldehyde); aromatic aldehydes, representative of which is benzaldehyde; heterocyclic aldehydes, such as furfural; etc. Preference, however, is given to the aliphatic aldehydes, formaldehydes being particularly preferred.

AMINES

Amines contemplated by the present invention are those which contain an amino group characterized by the presence of at least one active hydrogen or methylene group. Such amines may contain only primary amino groups, only secondary amino groups, or both primary and secondary groups. Typical amines are: ammonia, alkylene diamines (e.g., ethylenediamine, propylenediamine, hexamethylenediamine, N,N-dimethylpropanediamine); polyalkene polyamines (e.g., diethylene triamine, triethylene tetramine, tetraethylene pentamine); the aromatic amines (o-, m- and p-phenylene diamine, diamino naphthalenes); and hexamethylene tetramine, i.e., the reaction product of ammonia and formaldehyde; monoalkylamine such as methylamine, ethylamine, through octadecylamine; dialkylamines, such as dimethyleneamine through dioctadecylamine; (the acid substituted polyalkylpolyamines, e.g., N-acetyl tetraethylenepentamine, and the corresponding formyl-, propionyl- butyryl-, and the like N-substituted compounds; and the corresponding cyclized compounds formed therefrom, such as the N-alkyl amines of imidazolidine and pyrimidine.

THE CHEMISTRY OF THE MANNICH REACTION

The first step in the reaction forming Mannich bases is between the amine and aldehyde, e.g., ethylenediamine and paraformaldehyde. Several compounds can be formed:

$$H_2NCH_2CH_2NH_2 + HCHO \rightleftharpoons HOCH_2NHCH_2CH_2NH_2 \quad (1)$$

$$H_2NCH_2CH_2NH_2 + 2HCHO \rightleftharpoons HOCH_2NHCH_2CH_2NHCH_2OH \quad (2)$$

$$2H_2NCH_2CH_2NH_2 + HCHO \rightleftharpoons H_2NCH_2CH_2NHCH_2NHCH_2CH_2NH_2 + H_2O \quad (3)$$

$$2H_2NCH_2CH_2NH_2 + 4HCHO \rightleftharpoons (CH_2)_4(NCH_2CH_2N)_2 + 4H_2O \quad (4)$$

Combinations other than those shown are also possible. Which reaction predominates is not fully known. All are potential aminomethylating agents for the next step shown below wherein Y is a OH group.

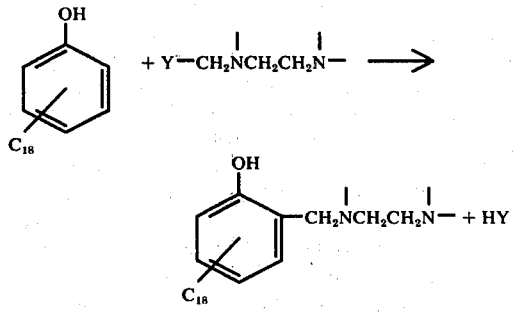

The positions ortho to the hydroxy groups on the ring are the most active. When both are available (e.g., para octadecylphenol) disubstitution occurs. It is also probable that both amine groups react. Thus low molecular weight polymers with the repeating unit,

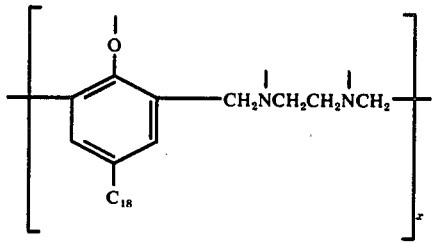

are probably formed. Molecular weight measurements suggest "X" could be as high as 10. The ortho alkylphenol isomer is less reactive than the para probably due to stearic hindrance.

THE COMPOSITION OF MANNICH BASES

The product additive obtained in this Mannich reaction depends on the mole ratios of reactants and to a lesser extent on reaction conditions.

When the ratio of octadecylphenol/ethylenediamine was 2:1.5, increasing the formaldehyde from 4 to 7 moles was actually detrimental to phenol conversion. An oil insoluble (water soluble) liquid phase that was difficult to filter also formed.

At 2 moles octadecylphenol and 4 moles formaldehyde, residual phenol in the product was around 20% with anywhere from 0.84 to 1.5 moles of ethylenediamine. Excess amine over that which can react with the phenol and aldehyde present strips from the product when water is removed at the end of the sequence.

It has also been found that the type of amine further affects the optimum molar ratios. This is illustrated as follows:

| Molar Ratio Range | | |
|---|---|---|
| Aromatic | Amine | Aldehyde |
| 2 | 1 ethylene-diamine | >2–4 |
| 2 | 1 diethylene-triamine | 3–5 |
| 2 | 1 tetraethylene pentamine | 4–7 |

TABLE IV

THE EFFECT OF MOLE RATIOS ON MANNICH BASE COMPOSITION

| Run No. | 72 | 74 | 73 | 67 | 109 | 107 |
|---|---|---|---|---|---|---|
| Reactant Mole Ratios, OP/EDA/HCHO* | 2:1:2.2 | 2:1:3 | 2:1:4 | 2:0.84:4 | 2:1.5:4 | 2:1.5:5 |
| TBN (Castrol) mg KOH/g** | 116 | 135 | 122 | 133 | 172 | — |
| Unconverted Alkylphenol, % | 39.5 | 31 | 23 | 20 | 20 | 27 |
| Insoluble Byproducts | | | | | | |
| Type | nil | trace solids | solids | solids | nil | liquid |
| Filterable | — | yes | yes | yes | | no |

*Octadecylphenol/Ethylenediamine/Paraformaldehyde
**Total Base Number

The way in which mole ratios affect product composition is illustrated by data in Table IV. Alkylphenol conversion improves significantly as the moles of formaldehyde/mole of alkylphenol is increased from 1 to 2. The best alkylphenol conversion was obtained with about 1 mole of diamine/2moles of alkylphenol and > 4 moles of formaldehyde. If the ratio of formaldehyde to ethylenediamine (HCHO:EDA) was <~1:3 some amine would go overhead during the stripping step. Conversely, HCHO went overhead at HCHO/EDA ratios <~1:3. A clear product was obtained when the HCHO:EDA ratio was < about 2.7. However, the amount of insoluble by-product was not intolerable up to a ratio of ~4.5:1 so long as it was solid rather than liquid. Solidification usually took place during the stripping step. The material was not positively identified but was water soluble and had strong amide-type keto adsorption in the infrared. The presence of aldehydic sugars is also suspected.

The octadecylphenol-ethylene diamine-paraformaldehyde molar ratios are further representative of the influence of these ratios. When the ratio of octadecylphenol/ethylenediamine was 2:1, increasing the formaldehyde from about 2 to 4 moles reduced the unconverted alkylphenol from 39 to 23%. Oil insoluble by-products start to form with 3 moles of formaldehyde and are more evident at 4. The insolubles dissolve readily in water and infrared shows very strong keto adsorption in the amide region. Going to 5 moles of formaldehyde did not result in a significant further reduction in unconverted octadecylphenol.

GENERAL REACTION CONDITIONS

The reactions were conducted in standard laboratory glass equipment. The alkylphenol and either the amine or paraformaldehyde were added to a three neck flask fitted with a paddle stirrer, reflux condenser and heating mantle with temperature control. The temperature was increased to 21°–27° C. in most experiments and the third component added slowly, maintaining the temperature below 34° C. Following the addition, the mixture was stirred at 27°–34° C. to complete reaction and then stripped to about 65° C. with nitrogen to remove water and sometimes unreacted amine or formaldehyde. In some cases filtration was necessary to remove oil insoluble byproducts. In addition, with branched side chain alkylphenols a solvent refined 30 grade petroleum basestock was sometimes added as a solvent for the reaction or as a diluent for filtration or use. Addition of the amine to a slurry of alkylphenol and paraformaldehyde was more facile than adding the aldehyde last. Temperature was easily controlled by addition rate. It was also found that all three reactants could be mixed together at <40° C. and then heated to reaction temperature. Methanol can be used as a solvent and KOH as a catalyst.

The stripping temperature and time should be minimized and balanced for the best results. Stripping temperature ranges from 120° to 150° C. are normally employed. The stripping time depends on the batch size, $N_2$ flow rate or vacuum available etc. but should be minimized consistent with removal of byproducts and unreacted materials. Extended stripping times, i.e., greater than 2 hours manifests itself in degradation of the product (ring bridging and/or breakdown of the benzoxazine rings) which in turn manifests itself in decreased base number, increased viscosity and poorer engine performance.

The reaction temperature should be between about 60° C. and 95° C. with a range of from 75° C, to 90° C. preferred.

The reaction is best conducted at a basic pH range of from about 10 to 12 preferred.

The Mannich base products of this invention can be water washed or post treated with an acid, e.g., glacial acetic acid. Treatment can be by dilution of the product to 50 wt. % in a 30 grade solvent refined basestock and the addition of the acid (one mole acid per mole of alkyl phenol used to make the Mannich) at 50° C. The mixture is then warmed to 80° C. and stirred for 2 hours. Finally it is stripped with $N_2$ to 150° C. and filtered. The TBN is only reduced to 126 from 135 (at 100% ai) and the viscosity (at 50% ai) goes from 137 to 161 SUS at 210° F. This post treatment with acetic acid seems to have a "clearing up" effect on the Mannich base probably as a result of mopping up residual amine and perhaps structure change.

The Mannich base products of the invention can be post treated with boron containing substances, e.g., borate esters such as tributyl borate or boric acid or metaboric acid, to introduce boron directly into the additive. Such an addition of boron by boration of these Mannich base products can be accomplished according to published techniques for formation of aminoborates and borate salts of amines, which addition enhances their corrosion inhibition and/or biostatic properties.

The 2-stroke cycle gasoline engine oil formulations of this invention may be further improved in some instances by including from 0.1 to 1 weight percent of an ashless antioxidant, such as a conventional amine type, e.g., phenyl alpha-naphthylamine, or phenolic type antioxidants, e.g., 2,6-di-tert.-butyl p-cresol, nonylphenylsulfide and phosphosulfurized terpenes. Bis phenols such as 4,4′ methylene bis(2,6-di-tert.-butyl phenol) are desirable antioxidants. Ashless rust inhibitors, selected from the wide variety of commercially available materials, e.g., alkenylsuccinic acids and ethoxylated phenols are well-known in the art for their tendency to improve the rust prevention of petroleum products in small concentrations. It is also permissible to add a very small amount of a phosphorus-containing antiwear agent, for example, 0.05 weight percent of zinc dialkyldithiophosphate, to attain added protection against wear and scuffing with little or no sacrifice in plug life.

The finished lubricant should be used to the extent of 1 volume per 50 volumes of gasoline, more or less, depending on engine design and the engine manufacturer's recommendations.

The following Examples illustrate the preparation of the Mannich bases used in this invention, wherein amounts are by weight unless otherwise indicated.

EXAMPLE 1

Water (26 g; 1.44 mole) suspended in n-heptene (400 ml) was saturated with $BF_3$ at ambient temperature thereby forming a $BF_3.xH_2O$ catalyst complex. Thereafter, phenol (964 g; 10.1 mole) and octadecene-1 (252 g; 1.0 mole) were added slowly with stirring. The temperature rose to 60° C. and was maintained there for 3 hours. Additional gaseous $BF_3$ was added occasionally. Thereafter, the product was washed with aqueous $Na_2CO_3$ to destroy the catalyst and remove the residues.

Distillation, first at atmospheric pressure and then under vacuum yielded overhead, n-heptane; unreacted phenol and an octadecylphenol fraction boiling between 411 and 423° C, corrected to atmospheric pressure (268 g; 0.77 mole).

The octadecylphenol prepared above (250 g; 0.722 mole); 91% ethylenediamine (19.8 g; 0.30 mole) and paraformaldehyde 43.4 g (1.45 mole) were mixed at ambient temperature. Gentle heating plus heat of reaction quickly brought the temperature to 95°–100° C. It was held there for about 2 hours and then the water formed in the reaction was removed by raising the temperature of the product to 150° C. while stripping it continuously with nitrogen. The product was a pale yellow liquid. Analysis by gas chromatography and infrared spectroscopy showed the presence of unreacted octadecylphenol (~20%) and benzoxazine ring functionality (IR adsorption at 10.75 mμ).

EXAMPLE 2

Phenol (1,053 g; 11.2 mole) was essentially saturated with gaseous $BF_3$ (the amount was not determined) at 70° C. Thereafter, octadecene-1 (565 g; 2.24 mole) was added slowly while the temperature was maintained at 70° C. After an additional ½ hour stirring, the catalyst was destroyed by neutralization with concentrated agueous $Na_2CO_3$ solution. The liquid product was decanted and filtered away from the bulk of the semi-solid neutralized catalyst residues and distilled to yield overhead unreacted phenol (containing some water) and an octadecylphenol fraction (577 g) boiling between 411° to 423° C. corrected at atmospheric pressure.

Octadecylphenol prepared as above (1458 g; 4.21 mole) and 92% ethylenediamine (137.4 g; 2.11 mole) were mixed and heated to 65° C. Paraformaldehyde (126.4 g; 4.21 mole) was added slowly so as to maintain the temperature below 91° C. The mixture was stirred for an additional 3 hours and then stripped to 150° C. with $N_2$ to remove water. The product (1627 g) was pale yellow in color and free of insoluble residues. It had a total base number (ASTM 2896) of 140 mg KOH/g.

EXAMPLE 3

Octadecylphenol prepared by the technique described in Example 2 (6100 g; 17.63 mole) and 92% ethylenediamine (575 g; 8.8 mole) were heated to 66° C. and paraformaldehyde 793 g; 26.5 mole was added slowly so as to maintain the temperature below 91° C. After a further reaction time of 1¼ hours at 85° C. water was stripped from the product with $N_2$. The maximum temperature attained was 135° C. The flask was then cooled and the liquid product separated from a small amount of insoluble resinous material on the walls by decantation to another vessel. Water (1 liter) was then mixed with the decanted material and the two phases were stirred together for 6 hours at 85° C. The aqueous phase was removed after overnight settling and the product again stripped to 135° C. using nitrogen. It was clear, bright and had a TBN (ASTM 2896) of 110 mg KOH/g.

EXAMPLE 4

Octadecylphenol was prepared by alkylating phenol with octadecene-1 using a five molar excess of phenol and an acid clay catalyst. The catalyst was separated by filtration and the unreacted phenol distilled overhead leaving a residue which was nominally octadecylphenol (95 parts) and dioctadecylphenol (5 parts).

The above alkylphenol (6100 g; 17.0 mole) and paraformaldehyde (1020 g; 34 mole) were heated to 80° C. and 92% ethylenediamine (466 g; 7.14 mole) was added slowly with stirring so as to maintain the temperature below 93° C. The product was then stripped of water using nitrogen up to 160° C. A 30 grade petroleum basestock was added to reduce the additive concentration to 50 vol %. The diluted product was filtered to remove insolubles using diatomaceous earth as a precoat and admix. After filtration, the additive was a clean amber liquid with a total base number (ASTM 2896) of 55 mg KOH/g.

EXAMPLE 5

Octadecylphenol prepared as in Example 4 (11350 g; 32 mole), diethylene triamine 1630 g; 16 mole) and formaldehyde (50% active, inhibited grade; 4495 g; 75 mole HCHO) were added in sequence to a reactor cooled to 40° C. The mixture was then warmed to 90° C. and maintained there for 1 hour. The temperature was then increased and the water of reaction distilled overhead. The last traces of moisture were removed by applying a vacuum at 115° C. Filteraid was added and the product passed through a precoated filter to remove insolubles. The final product was a clear amber liquid with a total base number of 146.

EXAMPLE 6

Octadecylphenol prepared as in Example 4 (359 g; 1.0 mole) and paraformaldehyde (39.3 g; 1.31 mole) were heated with stirring to 93° C. Tetraethylenepentamine (35.3 g; 0.187 mole) was added slowly so as to hold the temperature at 93° C. After an additional ¾ hour the product was stripped using nitrogen to 150° C. to remove water formed in the reaction. At this stage it only contained traces of insoluble byproducts and was not filtered. Infrared analysis suggested the product contained about 40% unreacted alkylphenol.

EXAMPLE 7

Paraformaldehyde (60 g; 2 mole) was dissolved in methanol (100 ml) containing potassium hydroxide (0.14 g). The solution was added with stirring to N,N-dimethyl-propane 1,3-diamine (102 g; 1 mole) maintaining the temperature below 40° C. When the reaction was complete, octadecylphenol, prepared as in Example 4 (358 g; 1 mole) was added with vigorous stirring. The temperature was raised to 150° C. over a 2 hour period and the methanol together with water of reaction removed by distillation. The product was filtered and stripped at 100° C. and 5 mm/Hg. It was a dark amber liquid having a total base number (ASTM 2896) of 82 mg KOH/g sample. Examination by infrared spectroscopy and proton nuclear magnetic resonance spectroscopy showed the presence of benzoxazine functionality.

EXAMPLE 8

A Mannich product was prepared from octadecylphenol (made as described in Example 4), ethylenediamine and paraformaldehyde in the molar ratios 2:1:3. The diamine was added to the phenol and paraformaldehyde at 93° C. Then the water was removed by $N_2$ stripping to 160° C. The product was cooled to 120° C. and acetic acid added slowly with stirring so the final ratio of reactants was 2:1:3:2 for OP:EDA:HCHD-:HOAC. The product had a total base number (ASTM 2896) of 126 compared to 135 before post treatment. The viscosity increased from 137 to 161 SUS at 210° F.

EXAMPLE 9

Octadecylphenol, prepared as in Example 4, (359 g; 1.0 mole) and hexamethylenetetramine (46.6 g; 0.3 mole) were stirred together and heated to 107° C. for 19 hours. The filtered product contained about 19% unconverted alkylphenol by IR analysis and showed weak adsorption at 9.9 mμ, a peak characteristic of unreacted hexamethylenetetramine.

EXAMPLE 10

Octadecylphenol prepared as in Example 4 (359 g; 1.0 mole) and paraformaldehyde (90 g; 3.0 mole) were heated to 82° C. 30% aqueous ammonia (56.6 g; 1 mole of $NH_3$) was added slowly and the mixture was heated at the same temperature for 3 hours. The product was stripped with $N_2$ to 150° C. and filtered. The yield of clear ambler liquid was 404 g. It had a total base number (ASTM 2896) of 94 mg KOH/g.

EXAMPLE 11

Phenol (7505 g; 79.8 mole) was warmed to 70° C. and treated with gaseous $BF_3$ (104 g). A nominal $C_{24}$ average carbon number polypropylene fraction (2754 g; 7.99 mole) was added over a period of 3 hours with stirring. The product was stirred for an additional ½ hour and neutralized with concentrated aqueous $Na_2CO_3$ solution. The product was decanted and filtered away from the semi-solid catalyst residues. Distillation, first at atmospheric pressure and then under vacuum gave an alkylphenol residue of 3192 grams boiling above 216° C.

Alkylphenol prepared in the manner described above (2885 g; 6.92 mole), a 30 grade solvent refined basestock (3095 g) and paraformaldehyde (311 g; 10.4 mole) were heated with stirring to 82° C. 92% Ethylenediamine (226 g; 3.46 mole) was added slowly while the temperature was maintained at 95° C. The product was then stripped to 150° C. with $N_2$ to remove water. The residue, 6315 g. was filtered using precoat and admix to give a clear viscous amber liquid.

ENGINE TESTING

The performance of Mannich bases as detergent/inhibitor additives was evaluated in a 1½ HP Homelite single cylinder two-cycle gasoline engine driving a water pump. (Model XLS-1½ -1A; made by Terry Industries, Pointe Claire, Quebec, Canada). The operating procedure was similar to one used by the Boating Industries Associates during attempts to develop a standard aircooled two-cycle engine test procedure in the late 1960's; (55 min. at full throttle; 5 min. idle for 7 hours; 1 hour shut down; repeat to 96 hours total test time.) The first 80 hours operation is at 6500 rpm. The load is then increased by changing the pump impeller. Thereafter, the rpm's are maintained at 5000. Spark plug fouling frequency and the number of preignitions are recorded during the run. At the end of the test, the engine is rated for port plugging, piston cleanliness, ring sticking and piston/cylinder liner scuffing. The test is considered to be very severe. With many oils the engine fails due to deposit buildup or lack of lubrication before 96 hours operating time has been attained.

The oils evaluated normally contained 7 to 10% treats of the Mannich base along with lesser amounts of conventional pour depressant and antirust additive. The basestocks were combinations of 30 and 60 grades along with 10% Bright Stock. The oils were diluted back with 20% of a straight-run naphtha fraction to improve mixing with the fuel. The fuel/oil dilution ratio was 50/1.

The Mannich bases described in Examples 1 through 6, 8, 9 and 11 or products made in other preparations but with the same starting materials and conditions were evaluated in the Homelite engine test. All tests ran the full 96 hours and gave acceptable engine ratings when compared to an additive package based on a commercial isostearic acid/tetraethylenepentamine type detergent/inhibitor.

When the molar ratio of the $C_{8-40}$ alkyl hydroxy aromatic reactant to the amine reactant is less than about 2, i.e., 1.5, and the aldehyde reactant is in molar excess to said aromatic reactant, the Mannich base product is difficulty separable from the unreacted amine and/or the byproducts become deleteriously excessive. For the purposes of this disclosure a ratio of said aromatic to said amine of about 2:1 respectively encompasses 2:0.8-1.2.

The useful products of this invention are characterized by a trace of to a high degree of ring formation, which ring structure is believed to be a benzoxazine configuration. With molar ratios of $2:1:2^{+}$-8 (aromatic:amine:aldehyde) a trace amount i.e., about 10 percent, to a high degree, i.e., in excess of about 25 percent, of benzoxazine formation is achieved. With the optimal ratio range of 2:1:3–7 substantial, i.e., about 15 percent to a high degree of benzoxazine formation is realized, particularly when the molar ratio is 2:1:4–7. The presence of benzoxazine structure can be readily determined by nuclear magnetic resonance and/or infrared analysis indicating a useful degree of benzoxazine ring formation. The benzoxazine ring structure is appropriately described as 2H 1,3-dihydrobenzoxazine.

The polymeric $C_{8-40}$ alkyl hydroxy N-substituted amines having substantial benzoxazine ring formation exhibit in gasoline a detergency property which manifests itself in cleanliness of engine parts which tend to exhibit harmful deposits, e.g., carburetor, intake manifold, valves, etc.

Even though the list of amines contemplated by the present invention included ammonia and its reaction product with formaldehyde, hexamethylene tetramine, they are unique in that the Mannich reaction generates ammonia which comes off in the effluent gases.

For this reason, reactions involving ammonia utilize an excess over that which would have been expected from the foregoing teachings. The Mannich base product from the ammonia reaction is contemplated to have benzoxazine ring formation in such trace amounts that they are difficult to discern with NMR and/or IF analytical means.

What is claimed is:

1. A combined lubricant and fuel composition for the lubrication of a 2-stroke cycle gasoline engine which comprises a gasoline to which has been added a minor amount of petroleum lubricating oil containing an oil soluble Mannich base as a detergent-antiscuff additive, said Mannich base comprising the reaction product of: about two molar proportions of $C_{14}$-$C_{24}$ mono alkyl phenol, about two to eight molar proportions of a formaldehyde, and about a molar proportion of a nitrogen containing material selected from the group consisting of ammonia, alkylene diamine, polyalkene polyamines, and hexamethylene tetramine, and wherein: said oil has been added in an amount of from about 1 to 5 parts and said Mannich base has added in an amount of from about 0.03 to 0.75 parts, per 100 parts of gasoline.

2. A composition according to claim 1, wherein said alkyl group is a $C_{16}$ to $C_{20}$ alkyl group.

3. A composition according to claim 2, wherein said alkyl phenol is octadecylphenol, and three to seven molar proportions of formaldehyde is used per molar proportions of said material.

4. A composition according to claim 1, wherein said material is ammonia.

5. A composition according to claim 1, wherein said material is alkylene diamine.

6. A composition according to claim 1, wherein said material is polyalkene polyamine.

7. A composition according to claim 1, wherein said material is hexamethylene tetramine.

8. A method of operating a 2-stroke cycle gasoline engine which comprises running said engine on the combined lubricant and fuel composition of claim 1.

* * * * *